United States Patent [19]

Carter et al.

[11] 4,299,091

[45] Nov. 10, 1981

[54] PORTABLE CRYOGENIC LIQUID STORAGE-GAS SUPPLY SYSTEM

[75] Inventors: William J. Carter; Lester K. Eigenbrod, both of Indianapolis, Ind.

[73] Assignee: Union Carbide Corporation, New York, N.Y.

[21] Appl. No.: 195,130

[22] Filed: Oct. 8, 1980

[51] Int. Cl.[3] ..... F17C 7/02

[52] U.S. Cl. ..... 62/50; 62/55; 137/590; 141/46

[58] Field of Search ..... 62/50, 51, 55; 137/590; 141/46

[56] References Cited

U.S. PATENT DOCUMENTS

| | | | |
|---|---|---|---|
| 2,983,311 | 5/1961 | Anders | 137/590 |
| 3,044,270 | 7/1962 | Biever | 62/55 |
| 3,199,303 | 5/1965 | Haumann et al. | 62/50 |
| 3,334,667 | 8/1967 | Hedstrom | 141/46 |
| 3,729,946 | 5/1973 | Massey | 62/51 |
| 3,797,262 | 3/1974 | Eigenbrod | 62/50 |
| 3,864,928 | 2/1975 | Eigenbrod | 62/50 |
| 3,938,347 | 2/1976 | Riedel et al. | 62/55 |
| 4,211,086 | 7/1980 | Leonard et al. | 62/50 |

*Primary Examiner*—Ronald C. Capossela
*Attorney, Agent, or Firm*—John J. Kelly, Jr.

[57] ABSTRACT

A portable cryogenic liquid storage-gas supply system including an evacuable double-walled cryogenic liquid container being invertible between a top-up dispensing and bottom-up filling positions wherein the container comprises a liquid withdrawal-gas vent tube terminating within the container near the bottom end, a gas vent-liquid fill tube positioned within and penetrating the wall of the liquid withdrawal-gas vent tube and terminating within the container near the top end, and a splash deflector within the container for redirecting a fluid discharged from the gas vent-liquid fill tube toward the container top end during liquid fill of the container.

3 Claims, 3 Drawing Figures

PORTABLE CRYOGENIC LIQUID STORAGE-GAS SUPPLY SYSTEM

This invention relates to a portable cryogenic liquid storage-gas supply system. More particularly, this invention relates to a portable cryogenic liquid storage-gas supply system having a cryogenic liquid storage-dispensing container with an improved liquid withdrawal-gas vent and gas vent-liquid fill conduit arrangement in conjunction with a fluid splash deflector.

BACKGROUND OF THE INVENTION

Portable liquid oxygen storage-gas supply units are small light weight devices which comprise a liquid oxygen storage container with associated systems to dispense the liquid oxygen as breathing oxygen for use by a person handicapped, for example, by pulmonary or cardiac disorders. These units provide the handicapped individual with improved mobility in comparison with large stationary oxygen supply devices.

Because these units are intended for use by the handicapped, it is especially important that they be light weight and compact, simple to use, reliable, and safe with the observance of only minimal precautions.

The requirement that the unit be light weight and compact results in the designed liquid oxygen storage capacity being small, for example, about 1 to 2 pounds of liquid oxygen. The unit must therefore be capable of being easily and safely refilled by the handicapped person in his home from a large stationary liquid oxygen supply source.

To provide maximum mobility away from a stationary oxygen source, it is necessary that the portable unit to be filled to design capacity with liquid oxygen. To insure safety, it is important that the unit be reliably filled to the capacity which the handicapped person expects to have available in order to preclude the premature exhaustion of the oxygen supply when the user is away from a stationary oxygen source.

Accordingly, the prior art has developed automatic fill termination systems in order to provide for the reliable refilling of portable oxygen supply units to design capacity and to prevent overfilling of the unit which could result in spillage of liquid oxygen with the attendant safety hazards such as frost bite of persons contacted and increased danger of fire and explosion. Such automatic systems minimize the operational participation of the handicapped person or other individual refilling the unit in the home and increase the reliability, simplicity and safety of the refill.

The art has thus sought to increase the reliability of such automatic fill termination systems. Furthermore, the art has sought to achieve structurally simple designs for such portable oxygen supply units which both decrease the unit's weight and increase the unit's reliability during refill and breathing use.

Portable liquid oxygen storage-supply units comprise a small evacuable double-walled insulated container suitable for storage of a cryogenic liquid. Typically, a first conduit penetrates the upper head of the container vessel and extends to near the bottom end of the vessel. Stored liquid oxygen is withdrawn through this conduit and through an associated vaporizer and control circuit to supply warm gas to the user for breathing purposes. A second conduit penetrates the upper head of the container vessel and terminates near the top of the unit for the purpose of venting excess pressure from the vessel as needed.

If the portable unit is filled in its upright position, the liquid withdrawal or dispensing conduit can function as a liquid fill conduit. Similarly, the vent conduit retains its venting functions.

The prior art has also developed inverted fill methods for portable oxygen storage-supply units. In this method, the portable unit is inverted to a top-down-bottom-up position over a large stationary liquid oxygen container for performing the fill. This results in an advantageous shorter connecting conduit between the two containers when the fill is taking place.

When an inverted fill method is used, the portable unit's excess presssure gas vent conduit functions as a liquid fill conduit and the breathing use liquid withdrawal conduit functions as a gas vent conduit.

Portable liquid oxygen storage-dispensing units which are invertible between a top-up dispensing and bottom-up filling positions are described in U.S. Pat. Nos. 3,797,262 and 3,864,928 to Eigenbrod. These patents likewise disclose automatic fill termination systems used to terminate the refilling of the portable unit.

Copending U.S. Patent Application Ser. No. 125,889 filed Feb. 29, 1980 discloses an improved automatic fill termination apparatus which may be advantageously incorporated with a portable liquid oxygen storage-supply unit intended for using the inverted fill method.

The automatic fill termination system of copending Application Ser. No. 125,889, the entire disclosure of which is incorporated herein by reference, utilizes a quick-closing plug type valve which is mounted in an uninsulated conduit circuit external to the portable unit's liquid oxygen storage container which is in fluid communication with the container's liquid withdrawal conduit. When inverted fill is taking place by liquid oxygen entering through the excess pressure gas vent conduit, gas is vented through the liquid withdrawal conduit, the external conduit circuit and through the quick-closing plug type valve to atmosphere. The quick-closing plug type valve is designed to close and terminate fill upon slight increases in pressure of the venting vapor. Thus, when the portable container becomes full, liquid oxygen will enter the liquid withdrawal conduit and flow toward the external uninsulated conduit circuit and vaporize whereupon the quickly-closing plug type valve promptly and dependably closes and terminates the fill thereby providing precise control and avoiding overfill.

Automatic fill termination systems for portable liquid oxygen storage-dispensing units therefore typically terminate the fill of the unit upon the sensing of the presence of liquid oxgen caused by the overflow of liquid oxygen from the filled container into the conduit circuit venting gas during the fill. Thus, liquid oxygen entrained with the venting gas during the fill could prematurely cause the fill termination effect intended to occur when the container is full and liquid oxygen is just about to commence overflow through the vent circuit.

If entrained liquid oxygen in the venting gas does not cause premature termination of the fill, its presence will still result in excessive cooling of the conduit circuit venting gas during the fill and the means for sensing the presence of liquid oxygen in this circuit and therefore may result in a decrease in the sensitivity of the automatic fill termination system being used. In either event, the reliable, precise control to insure a complete fill but avoid an overfill is being impaired.

Finally, entrained liquid oxygen in the venting gas during the fill operation leads to undesirable transfer losses.

As hereinbefore discussed, a portable liquid oxygen storage-supply unit intended to be replenished with liquid oxygen by the inverted fill method includes two conduits which penetrate the top of the storage-dispensing evacuable double-walled container when it is in its upright normal breathing use orientation. A first conduit extends to near the bottom of the container (when in upright orientation) and serves the dual function of a liquid withdrawal conduit when the container is positioned in its top-up breathing oxygen dispensing mode and as a gas vent conduit when the container is positioned in its inverted bottom-up liquid oxygen filling mode. This first conduit may be referred to as a liquid withdrawal-gas vent conduit. A second conduit terminates near the top of the container (when in upright orientation) and serves the dual function as an excess pressure gas vent conduit when the container is positioned in its top-up breathing oxygen dispensing mode and as a liquid fill conduit when the container is positioned in its inverted bottom-up liquid oxygen filling mode. This second conduit may be referred to as a gas vent-liquid fill conduit.

Since the portable liquid oxygen storage-dispensing container is an evacuable double-walled container constructed to provide a vacuum insulation space between the two walls, it is desirable to provide for a single conduit penetration to minimize construction seals which have the potential for leakage. The prior art has placed the two dual function conduits side by side passing through a single opening essentially along the axial center line of the container in conjunction with suitable support and plugging arrangements. Alternately, the prior art has used a relatively complex manifold arrangement at the inner side of the container penetration to provide for the fluid path of the two dual purpose conduits into the container storage space.

A need, therefore, exists for an invertible liquid oxygen storage-dispensing container wherein the liquid withdrawal-gas vent conduit and the gas vent-liquid fill conduit are arranged for a structurally simple penetration of the top end of the double-walled container and a structurally simple termination of the respective conduits in their appropriate locations within the storage container which arrangement also provides for liquid oxygen fill of the container in its inverted position without excess entrainment of liquid oxygen in the venting gas during the container fill.

OBJECT OF THE INVENTION

It is therefore an object of the present invention to provide an invertible double-walled liquid oxygen storage-dispensing container for use in a liquid oxygen-gas supply system wherein the container's liquid withdrawal-gas vent conduit and gas vent-liquid fill conduit are arranged for a structurally simple penetration of the top of the container.

It is a further object of the present invention to provide such an invertible liquid oxygen storage-dispensing container wherein the container's liquid withdrawal-gas vent conduit and gas vent-liquid fill conduit are also arranged for a structurally simple termination of the liquid withdrawal-gas vent conduit near the bottom of the container and the structurally simple termination of the gas vent-liquid fill conduit near the top of the container.

It is, moreover, a further object of the present invention to provide such an invertible liquid oxygen storage-dispensing container having a structurally simple liquid withdrawal-gas vent and gas vent-liquid fill conduit arrangement wherein when the container is placed in its inverted bottom-up liquid oxygen fill position, disengagement of liquid oxygen from the venting gas resulting from the filling of the container will be achieved in a reliable, structurally simple manner in order to minimize liquid oxygen entrained in the vent gas so as to prevent a premature termination of a fill by effecting activation of an automatic fill termination system; to prevent excessive cooling of an automatic fill termination system resulting in decreased sensitivity for the automatic fill termination system; and/or to prevent undesirable transfer losses during the fill operation.

These and other objects will be apparent from the following description and claims in conjunction with the drawings.

SUMMARY OF THE INVENTION

The present invention may be generally characterized as a cryogenic liquid storage-gas supply system including a double-walled cryogenic liquid storage container having top and bottom ends and being invertible between top-up dispensing and bottom-up filling positions, said container comprising:

(i) an inner wall forming an enclosed volume for receiving a cryogenic liquid;

(ii) an outer wall substantially coextensive with and spaced from said inner wall arranged and constructed with respect to said inner wall so as to form an evacuable space therebetween;

(iii) thermal insulation material disposed within said evacuable space;

(iv) liquid withdrawal-gas vent conduit means including a continuous tube penetrating and gas tightly joined to said inner and outer walls at the container top end said tube having a first end terminating near the enclosed volume bottom end and a second end terminating outside the container top end;

(v) gas vent-liquid fill conduit means including a tube positioned within said liquid withdrawal-gas vent tube and penetrating the wall of said liquid withdrawal-gas vent tube at a position located near the enclosed volume top end and extending through the second end of said liquid withdrawal-gas vent tube, said gas vent-liquid fill tube having a first end terminating near the enclosed volume top end and oriented to discharge a fluid directed away from said container top end and a second end terminating outside the container top end;

(vi) means within said enclosed volume external to said liquid withdrawal-gas vent tube for deflecting the fluid discharged from said first end of said gas vent-liquid fill tube toward the container top end.

In a particular embodiment of the present invention the fluid deflecting means (vi) comprises a truncated cone mounted on and substantially concentrically surrounding said liquid withdrawal-gas vent tube having an open bse oriented to face the container top end and positioned so that the geometric extension of the perimeter of said gas vent-liquid fill tube discharge end intersects the side of said cone.

DESCRIPTION OF THE PREFERRED EMBODIMENT

In order to afford a complete understanding of the present invention and an appreciation of its advantages, a description of preferred embodiments is presented below.

Figure 1:
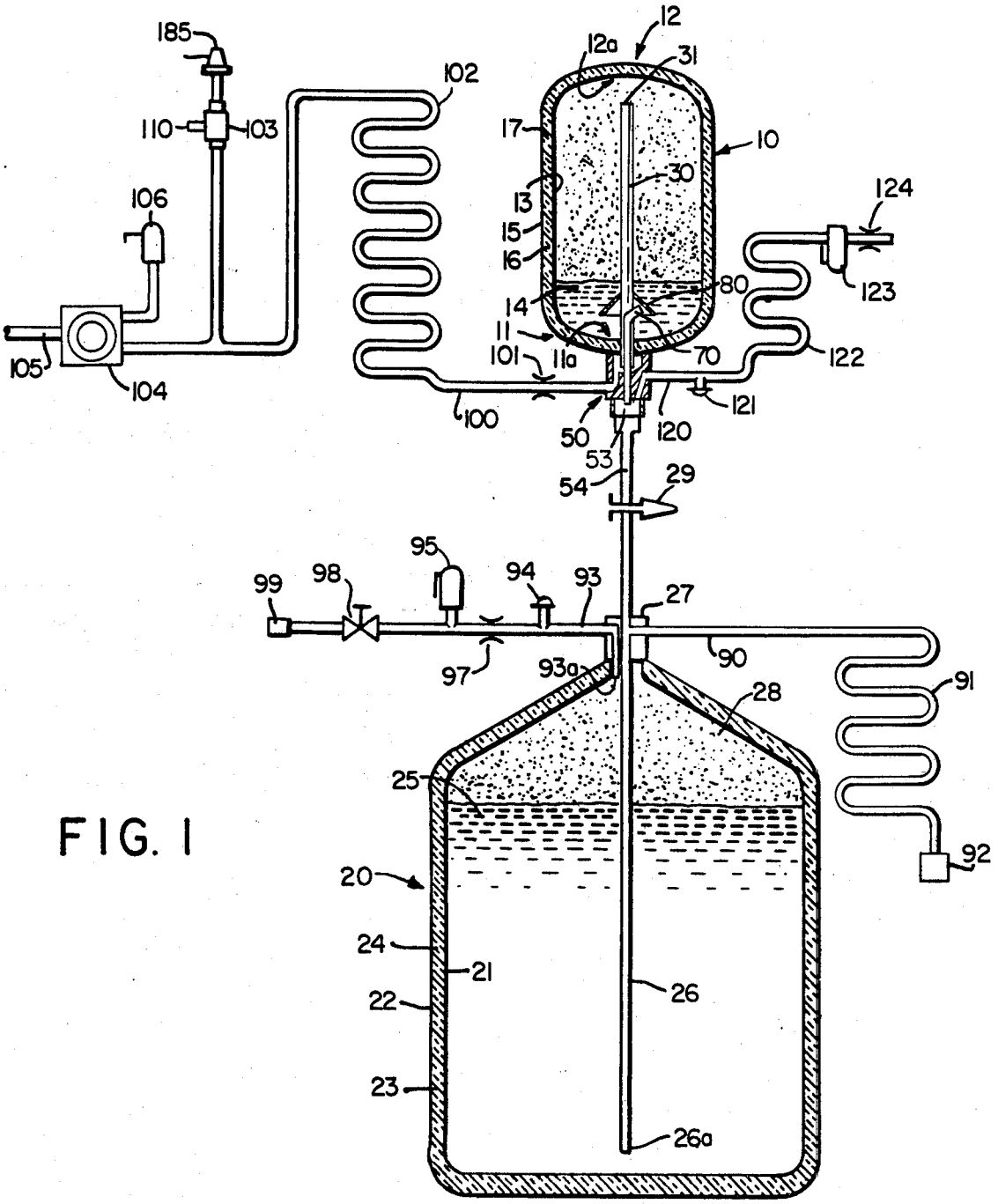
FIG. 1 is a schematic drawing in cross-sectional elevation of a cryogenic liquid storage-gas supply system showing a portable cryogenic liquid storage container of the present invention in the inverted fill position over a primary cryogenic liquid storage container.

With reference to the drawings, FIG. 1 illustrates a portable liquid oxygen storage-dispensing container 10 of the present invention oriented in its inverted position with its top end 11 facing down and its bottom end 12 facing up with respect to the vertical. Storage-dispensing container 10 is positioned over and joined in fluid communication to large primary liquid oxygen storage container 20 for fill of portable liquid oxygen storage-dispensing container 10. Stated otherwise, FIG. 1 illustrates portable liquid oxygen storage-dispensing container 10 of the present invention in its bottom-up "fill" position.

Portable liquid oxygen storage-dispensing container 10 is an evacuable double-walled cryogenic liquid storage container comprising an inner wall 13 forming an enclosed volume for receiving a cryogenic liquid 14 (in this instance liquid oxygen). Outer wall 15 is substantially coextensive with and spaced from inner wall 13 to form evacuable space 16. Evacuable space 16 is substantially filled with a thermal insulation material 17 suitable for cryogenic service. Such insulations include well known composite multilayered insulations comprising radiation barrier material interleaved with low heat conductive spacer materials. Particulate thermal insulations intended for use in cryogenic service could also be used. The evacuable space 17 would be evacuated, for example by using a vacuum pump, to a vacuum of about $5\times10^{-3}$ to $5\times10^{-5}$ torr by connection to an appropriate fitting (not shown) in the outer wall 15. A gettering material or molecular sieve or other adsorbent material (not shown) would be advantageous disposed in evacuable space 16 for maintaining the vacuum in accordance with the well known practice of the art.

Vertical tube 30 penetrates inner wall 13 and outer wall 15 at top end 11 of the container 10 (suitably at the axial center line of container 10) and extends external to the container to provide for access to the enclosed volume formed by inner wall 13. Tube 30 is gas tightly joined to inner wall 13 and outer wall 15 about its circumference, for example by welding or brazing, as better illustrated in the detail of FIG. 2 at 18 and 19. Thereby, the vacuum integrity of evacuable space 16 is maintained.

Tube 30 has a first end 31 which terminates near the enclosed volume bottom end 12*a* (top-up position) and a second end 32 which terminates external to outer wall 15, i.e., outside the top end 11 of container 10.

Advantageously, second end 32 of tube 30 terminates within chamber 51 of flow control-support block 50. In the embodiment illustrated in FIG. 2, support plate 60 is joined, e.g., by weld 61, to the external side of outer wall 15 of the top end 11 of container 10 in a region surrounding the penetration of outer wall 15 by tube 30. Support plate 60 is gas tightly joined to the circumference of tube 30 by weld 64 to provide addition support to tube 30. Flow control-support block 50 is gas tightly joined to support plate 60 by weld 62. Flow control-support block 50 comprise a plurality of fluid flow chambers and machined parts to provide for fluid circuit connections as will be hereinafter described.

Tube 30 provides a fluid path to near the bottom of the container enclosed volume 12*a* (top-up position) and thus can function as a liquid withdrawal conduit when the container 10 is in a top-up position for dispensing liquid and as a gas vent conduit when the container 10 is in an inverted bottom-up fill position (illustrated in FIG. 1) as will hereinafter be more fully described.

Figure 2:
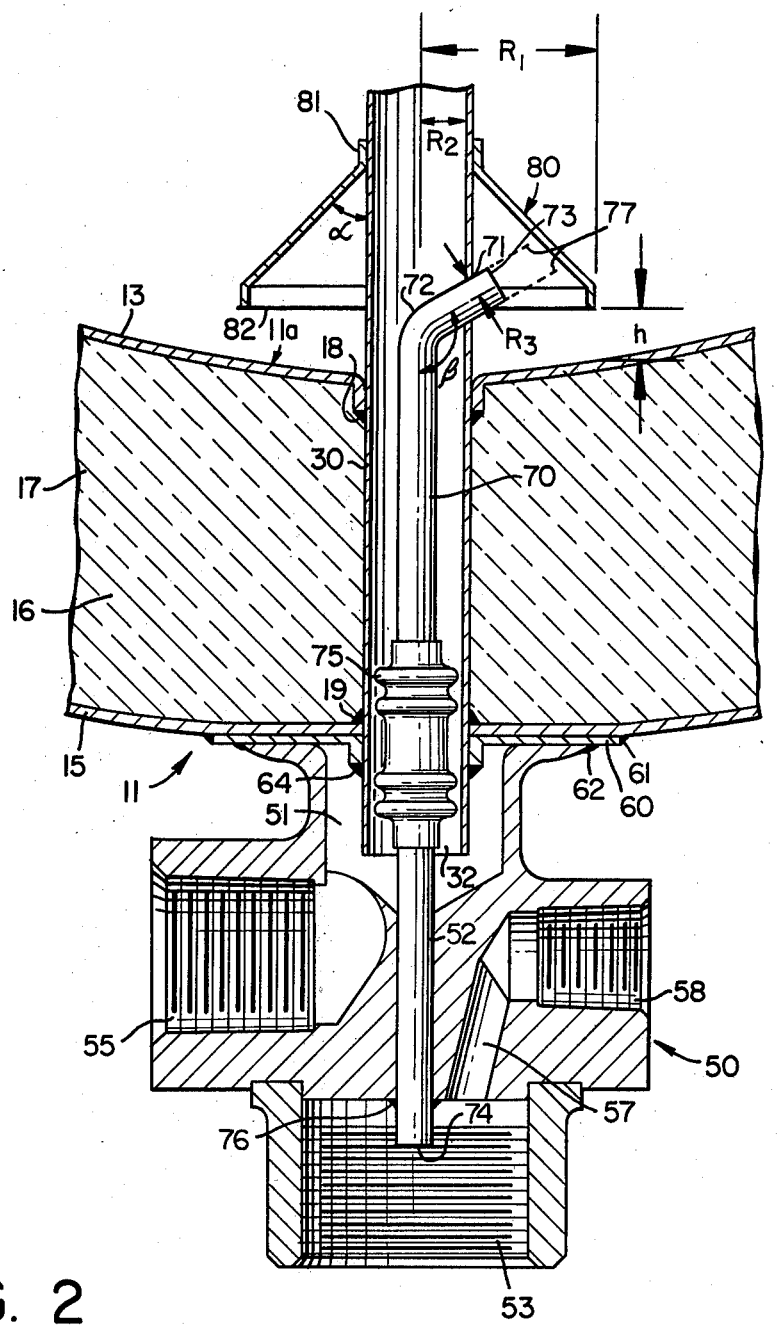
FIG. 2 is an enlarged cross-sectional detail of the penatration of the top of the portable cryogenic liquid storage container (in the inverted fill position) of FIG. 1 in accordance with the present invention.

Tube 70 is positioned within tube 30 preferably with the central axis of tube 30 substantially coinciding with the central axis of tube 70. The outer diameter of tube 70 is smaller than the inner diameter of tube 30. The respective tube diameters are selected to provide fluid paths within tube 70 and in the area between the outer diameter of tube 70 and inner diameter of tube 30 to meet desired fluid flow rates. Referring particularly to FIG. 2, tube 70 penetrates the wall of tube 30 at position 71 near the upper end 11*a* of the enclosed volume of container 10. The penetration at 71 is made gas tight and provides support for tube 70 for example by brazing. The bend 72 in tube 70 can typically range from a angle $\beta$ of about 100° to 165° with an angle of 151° to 155° having been found to be advantageous. After the penetration of the wall of tube 30 at 71, tube 70 extends a short distance, e.g., 1/10 to 3/10 inches, into the enclosed volume and terminates at first end 73 near the top end 11*a* of the enclosed volume.

Tube 70 penetrates walls 13, 15 of container 10 inside tube 30 and extends through the second end 32 of tube 30, through chamber 51 of flow control-support block 50 and into and through passage 52 of block 50 terminating at second end 74 in chamber 53 of block 50. Tube 70 is supported by passage 52, for example, by force fit and/or appropriate welds 76. Bellows joint 75, i.e., an expansion joint, is provided in tube 70 to relieve thermal stresses since tube 70 is rigidly joined to the wall of tube 30 at penetration 71 and rigidly joined to flow control-support block 50 at passage 52.

Tube 70 provides a fluid path to near the top of the container enclosed volume 11*a* (top-up position) and thus can function as an excess pressure vent conduit when the container 10 is in a top-up position for dispensing liquid and as a liquid fill conduit when the container 10 is in an inverted bottom-up fill position (illustrated in FIG. 1) as will be hereinafter more fully discussed.

It is to be noted that the concentric arrangement of tubes 30 and 70 results in needing only one penetration of container walls 13, 15 forming evacuable space 16 and thus provides a structurally simple arrangement for a two conduit penetration. Since only one penetration is required, reliability in maintenance of the gas tight integrity of the evacuable space is increased. Furthermore, only outer tube 30 is gas tightly joined to inner and outer walls 13, 15, and the need for penetration plugs gas tightly joined to the container walls and conduits gas tightly joined and passing through the plug is eliminated. Thus the present invention provides for a structurally simple arrangement at the critical location of conduit penetration of the walls of an evacuable double-walled container.

Mounted on the external wall of tube 30 within the enclosed volume of container 10 is splash deflector 80. Splash deflector 80 may be joined at 81 to the external wall of tube 30 by any suitable means such as force fit, welding or brazing. As illustrated in the drawings, splash deflector 80 has a preferred space of a truncated cone. The side walls of the truncated cone advantageously substantially concentrically surround tube 30. The open base 82 of truncated cone splash deflector 80 is oriented to face the top end 11*a* of the enclosed volume, i.e., the top end 11 of container 10. Truncated cone 80 is mounted on tube 30 at a selected position so that the geometric extension 77 of the perimeter of the discharge end (i.e., the first end 73) of tube 70 intersects the side walls of cone 80. That is, the discharge end 73 of tube 70 is shielded by cone 80. When the bend 72 of tube 70 has an angle $\beta$ of between about 100° to 165°, a fluid discharged from end 73 of tube 70 is directed away from the top 11 of container 10. Accordingly, a fluid discharged from first end 73 of tube 70 will be directed away from the top end 11 of container 10 and deflected by the walls of cone 80 toward the top of the container enclosed volume 11*a*—i.e., toward the top end 11 of container 10.

The cone angle $\alpha$, i.e., the acute angle formed by the intersection of a line parallel to the central axis of the cone with the side wall of the cone, is suitably from about 30° to 60° with an angle of about 45° being advantageous. Such angles are desirable to insure that deflected fluid discharged from end 73 of tube 70 will be properly redirected toward the top 11 of container 10 for reasons hereinafter discussed.

The ratio of radius $R_1$ of open base 82 of cone 80 to the radius $R_2$ of tube 30 is suitably about 2:1 to 5:1 with about 3:1 being advantageous. The ratio of the radius $R_2$ of tube 30 to the radius $R_3$ of tube 70 is suitably about 2:1 to 4:1 with a ratio of about 3:1 being advantageous. The height h measured from the open base 82 of cone 80 to inner wall 13 at the enclosed volume top end 11*a* would typically be about $\frac{1}{8}$ to $\frac{3}{8}$ inches.

Adherence to the above parameters will insure that a deflected fluid discharged from end 73 of tube 70 will be redirected toward the top of enclosed volume 11*a* in such a manner that the velocities of the deflected fluid are not excessive so that suitable disengagement of liquid and gas during a liquid oxygen fill of container 10 will be achieved.

The described splash deflector having the shape of a truncated cone is a preferred embodiment of the present invention for achieving the desired fluid redirection and satisfactory liquid gas disengagement. However, the splash deflector for deflecting a fluid discharged from tube 70 toward the top of the enclosed volume 11*a* during liquid oxygen fill of container 10 may take on other geometric shapes. Suitable geometries will be such that they shield the discharge end 73 of tube 70 and deflect or redirect the fluid discharged toward the container 10 top end 11 (i.e., enclosed volume top end 11*a*).

Referring to FIG. 1, large primary liquid oxygen storage container 20 is an evacuable double-walled cryogenic liquid container comprising spaced apart inner wall 21 and outer wall 22 having evacuable space 23 therebetween filled with thermal insulation material 24 suitable for cryogenic service. Inner wall 21 forms an enclosed volume for receiving a cryogenic liquid 25, in this instance liquid oxygen. Container 20 includes vertical conduit 26 which extends to near the bottom of container 20 at first end 26*a* and extends external to container 20 passing through plug-manifold block 27 at the top of container 20. Conduit 26 may be used for both liquid filling and withdrawal purposes. Liquid withdrawal for stationary breathing oxygen use may be made with suitable control 92 through conduit 90 including vaporizer coil 91 which would convert the liquid oxygen to ambient temperature gas.

The vent-pressure relief system for container 20 includes conduit 93 having a first end 93*a* terminating in gas space 28 in the top of container 20. Vent-pressure relief conduit 93 includes bursting disc 94 for release of rapid overpressure and pressure relief valve 95 for release of more gradual overpressure. Valve 98 is opened for liquid fill of container 20 from a liquid oxygen source. Flow restrictor 97 maintains a back pressure in the enclosed volume of container 20 (for example, typically about 55 psig) when container 20 is being filled with liquid oxygen through conduit 26. The gas that bleeds off flows through fitting 99 to prevent a direct jet of gas entering into the room environment. Plug-manifold block 27 provides support for these conduits.

Portable liquid oxygen storage-dispensing container 10 is illustrated in FIG. 1 in its inverted fill position with its top end 11 facing down. Vertical conduit 54 extends from and is supported by flow control-support block 50 and is joined in fluid communication with conduit 26 of liquid oxygen container 20 by quick disconnect valve unit 29. Conduit 54 is in fluid communication with tube 70 of container 10 by way of chamber 53 of flow control-support bock 50 (FIG. 2). A fluid path is thus established from the enclosed volume of primary liquid oxygen storage container 20, through conduit 26, quick disconnect valve unit 29, conduit 54, chamber 53, and tube 70 into the enclosed volume of portable liquid oxygen storage-dispensing container 10. The fill of container 10 will be hereinafter discussed.

Automatic fill termination system conduit 100 is joined in fluid communication with tube 30 of container 10 through chambers 55 and 51 (FIG. 2) of flow control-support block 50. Automatic fill termination conduit 100 includes flow restrictor 101, warming coil 102 and automatic fill termination valve 103. Valve 103 is a quick-closing plug type valve. Such an automatic fill termination system is of the type disclosed in copending U.S. Patent Application Ser. No. 125,889. The automatic fill termination system will be hereinafter discussed in conjunction with the fill of container 10.

Portable liquid oxygen storage-dispensing container 10 would be filled with liquid oxygen from primary liquid oxygen storage container 20 in the following manner.

The pressure in the gas space 28 of container 20 is maintained by pressure relief valve 95 at, for example, about 54 to 58 psig. Fill termination valve 103 is opened by depressing knob 185 thereby providing a fluid path to atmosphere from the enclosed volume of container 10 through tube 30, flow control-support block 50, and fill termination conduit circuit 100. Liquid oxygen 25 in primary storage container 20 will enter conduit 26 through conduit end 26*a* near the bottom of container 20. The liquid oxygen will flow up conduit 26, through quick-disconnect unit 29, through conduit 54, into chamber 53 of flow control-support block 50 and thence into tube 70. The liquid oxygen will be discharge from end 73 of tube 70 directed away from the top 11 of container 10 due to the angle $\beta$ of bend 72 being about 100° to 165° and against splash deflector 80 and is then deflected by splach deflector 80 toward the top of the enclosed volume 11*a*, i.e., the top end 11 of container 10. The liquid oxygen discharged from end 73 of tube 70 will be partly in gaseous form due to heating of the liquid oxygen while passing through conduit external to the insulated cryogenic containers 10 and 20 and as a result of the liquid oxygen attaining thermal equilibruim in the lower pressure of container 10 enclosed volume which is suitably about 46 to 56 psig. The liquid oxygen level 14 of container 10 rises as a result of the transfer.

Gas is vented from the enclosed volume of container 10 through tube 30 by entering through end 31 near enclosed volume bottom end 12*a* and thence through flow control-support block 50 and automatic fill termination conduit circuit 100 to atmosphere.

The automatic fill termination system functions as follows. Venting gas entering conduit 100 passes through non insulated coil 102 which is a heat addition zone, through quick-closing plug-type valve 103 and is discharged to atmosphere through conduit 110. Flow restrictor 101 maintains a sufficient back pressure on the liquid oxygen in container 10 so that immediately after the filling operation is completed, the container 10 liquid oxygen may be dispensed to a consumer under its own pressure. If such back pressure is not maintained, not only will the liquid oxygen loss its thermal energy needed for dispensing, but in addition a large amount of liquid oxygen being transferred will flash off as vapor and will be needlessly lost through the vent system. Typically back pressure maintained in container 10 during fill is about 46 to 56 psig.

When container 10 is filled to a desired level corresponding to end 31 of tube 30, liquid oxygen passes with the venting gas into and through the vent system. When liquid oxygen reaches non insulated coil 102 (a heat addition zone) it vaporizes, increasing its volume by several hundred-fold. This sudden surge "trips" the quick-closing plug-type valve 103 and closes fill termination circuit 100. When this occurs, the transfer of liquid oxygen into container 10 continues only momentarily until the pressures in the two interconnected containers 10 and 20 are equalized. The transfer of liquid oxygen then ceases because of the closing of valve 103 and container 10 is disconnected at quick-release unit 29 and returned to its top-up position for breathing use.

Figure 3:
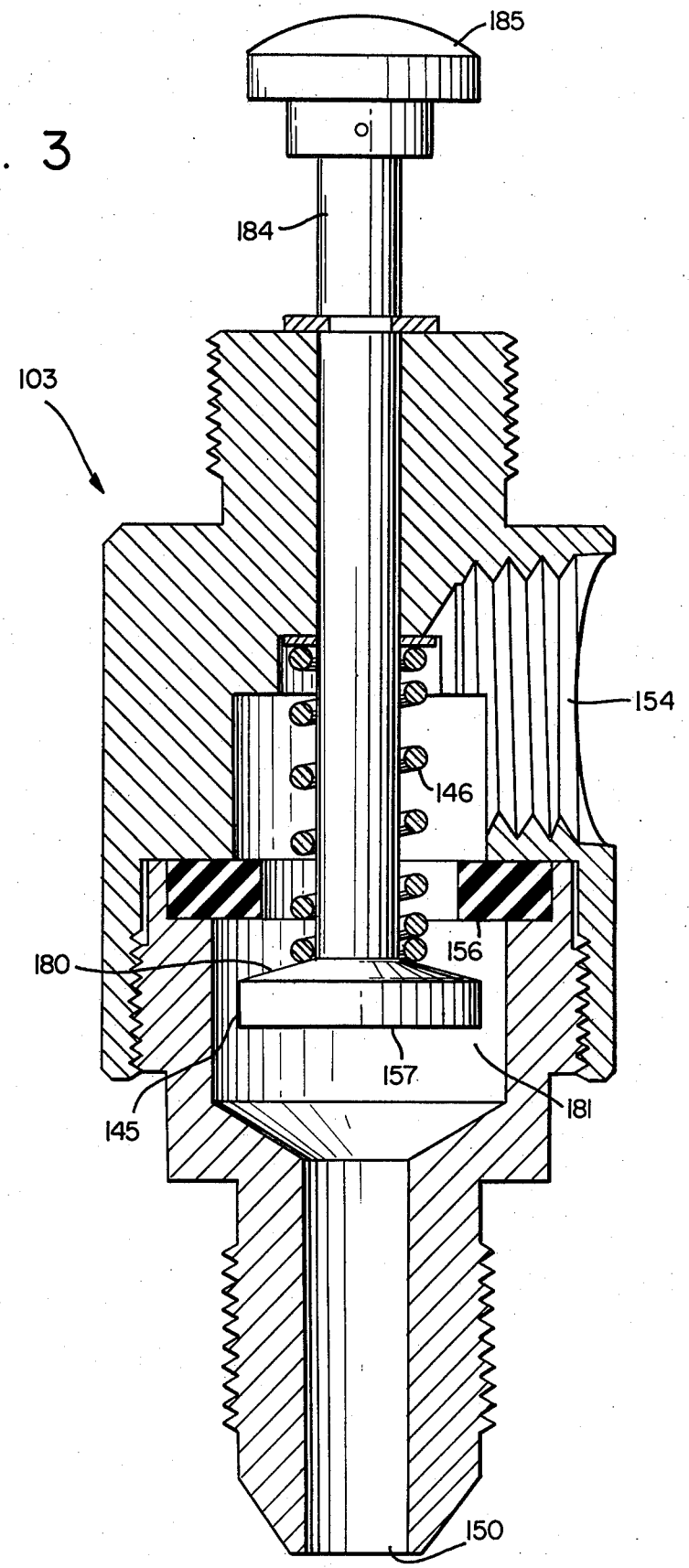
FIG. 3 is a cross-sectional detail of quick-closing plug-type fill termination valve 103 of FIG. 1.

A representative quick-closing plug type valve 103 is a model X-835-C valve manufactured by Humphey Products Co., Kalamazoo, Michigan and is illustrated in FIG. 3. However, similar valves may be used by one skilled in the art.

Referring to FIG. 3, valve 103 functions as follows. Fluid flowing through conduit 100 enters valve inlet 150 and is discharged through valve outlet 154 to conduit 110 and then to atmosphere. Valve 103 has a plug movement means comprising piston 145 which is axial movable between the illustrated full-open position to the full closed position. The piston 145 is biased to the open position by mechanical spring 146 retained against upper end surface 180 of piston 145.

Fluid entering valve inlet 150 flows through valve internal cavity 181 and discharges through outlet 154. When fluid flow velocity increases to a predetermined value, it exerts sufficient force against the internal, inlet facing surface 157 of piston 145 to axially move the piston away from the inlet. Upper end surface 180 of the piston 145 provides a sealing surface and is forced against seat 156 and terminates the fluid flow. The valve will remain closed as long as the pressure remains sufficient to overcome the counteracting force of spring 146.

When the valve 103 is closed, it can be manually opened by pressing knob 185 inwardly. This forces, via steam 184, the upper end surface 180 of piston 145 off seat 156 and disengages the sealing surfaces 180-156. The differential pressure tending to force the upper end surface 180 of piston 145 against the seat 156 is thereby reduced, and flow is again established through the valve. If the rate of flow is below the critical selected pressure for closure, the valve will remain open after pressure on knob 185 is removed.

Other types of quick-closing plug type valves suitable for use in automatic fill termination system conduit 100 in place of the herein described valve 103 are disclosed in copending U.S. Patent Application Ser. Nos. 125,889 and 125,793.

When portable liquid oxygen storage-dispensing container 10 is in its top-up position for breathing use, it functions as follows. Liquid oxygen flows up tube 30 entering at end 31 near the enclosed volume bottom end 12*a*. That is, tube 30 now provides a liquid withdrawal function for container 10. The liquid oxygen flows up tube 30, through flow control-support block 50 and thence into automatic fill termination system conduit 100 which now functions to supply breathing oxygen. The liquid oxygen vaporizes in non insulated coil 102 (a heat addition zone) and is warmed to ambient temperature. The warm oxygen gas will pass through control device 104 which is now open to supply a selected flow rate of oxygen gas to a user through conduit 105 which would be typically connected to a suitable breathing mask or the like. A safety pressure relief device 106 is also provided. Note that quick-closing plug type valve 103 would be closed when conduit 100 is supplying breathing gas.

When container 10 is in its top-up position for breathing use, primary excess pressure relief venting for the enclosed volume of container 10 is provided by tube 70 which terminates at end 73 near the enclosed volume top end 11*a* and which is in fluid communication with atmosphere via flow control-support block 50 and conduit 120. That is, during upright breathing use, tube 70 provides a gas vent function for the excess pressure of container 10.

Gas enters end 73 of tube 70 and exits through end 74 into chamber 53 of flow control-support block 50 (FIG. 2). Flow continues through chambers 57 and 58 and into excess pressure relief conduit circuit 120 which is joined to chamber 58. Excess pressure relief conduit circuit 120 includes bursting disc 121, warming coil 122 for warming gas which will ultimately be released to atmosphere, safety relief valve 123 and flow restrictor 124 which maintains pressure in the enclosed volume of container 10 during breathing use.

Gas vent-liquid fill tube 70 may suitably be a thin wall tube having a nominal diameter of about $\frac{1}{8}$ inch. Liquid withdrawal-gas vent tube 30 may suitably be a thin wall tube having a nominal diameter of about $\frac{3}{8}$ inch. Sizes may be varied by one skilled in the art in accordance with design requirements.

End 31 of tube 30, which terminates near the enclosed volume bottom end 12*a*, would typically terminate at a distance from inner wall 13 at the enclosed volume bottom end 12*a* at about 1/32 to $\frac{1}{8}$ inches. End 73 of tube 70, which terminates near the enclosed volume top end 11*a*, would typically terminate at a distance from inner wall 13 at the enclosed volume top end 11*a* at about $\frac{1}{8}$ to $\frac{3}{8}$ inches. It will be apparent to one skilled in the art that the closer the tubes 30 and 70 terminate to their respective ends, the greater will be design liquid storage capacity for a container of a given volume.

Referring to FIG. 2, the distance h measured from the open base 82 of splash deflector truncated cone 80 to inner wall 13 at the enclosed volume top end 11*a* would typically be about $\frac{1}{8}$ to $\frac{3}{8}$ inches. The foregoing parameters may be varied by one skilled in the art in accordance with design requirements.

EXAMPLE

A portable liquid oxygen storage-supply system having a container as described herein including a splash deflector with the shape of a truncated cone was constructed and a substantially identical container was constructed without a splash deflector.

The container had a generally cylindrical shape. The vertical height of the enclosed volume was about 4.3 inches and the diameter of the enclosed volume was about 4.0 inches. Gas vent-liquid fill tube 70 had an inside diameter of about 0.12 inches and a tube wall thickness of about 0.005 inches and terminated at end 73 about 0.25 inches from inner wall 13 at the enclosed volume top end 11*a*. The angle $\beta$ of bend 72 was about 153°. Liquid withdrawal-gas vent tube 30 had an inside diameter of about 0.36 inches and a wall thickness of about 0.1 inches and terminated at end 31 about 0.1 inches from inner wall 13 at the enclosed volume bottom end 12*a*.

The nominal design liquid oxygen capacity of the container was about 1.5 pounds when full.

In the container constructed in accordance with the present invention using a splash deflector having the shape of a truncated cone, the angle $\alpha$ of the cone walls was about 40°, the diameter of the open base 82 was about 1.2 inches and the distance h from open base 82 to inner wall 13 at the enclosed volume top end 11*a* was about 0.25 inches.

The fill termination circuit 100 contained a quick-closing plug type valve 103 of the type described herein fitted with a light spring 146 designed to close when passing ambient air to the atmosphere with an upstream pressure of about 64 to 72 psig. Flow restrictor 101 was an orifice having a diameter of 0.047 inches. Warming coil 102 was an non insulated $\frac{1}{4}$ inch diameter tube having a length of 15 feet 9 inches.

The parameters listed in the foregoing are average valves.

A series of tests were conducted wherein a portable liquid oxygen storage—dispensing container 10 without a splash deflector and with a splash deflector in accordance with the present invention were filled with liquid oxygen using the inverted fill mode as herein described from a primary liquid oxygen storage container 20 having a nominal full capacity of about 40.4 pounds of liquid oxygen. The fills were conducted with the primary liquid oxygen storage container having a supply pressure of about 54 to 58 psig. The pressure in the enclosed volume of portable liquid oxygen storage dispensing container 10 was maintained at about 46 to 56 psig. It is to be noted that for any particular fill, the pressure in the enclosed volume of container 10 would be less than the pressure in the enclosed volume of container 20. Tests were conducted when the portable container was both in a warm and cold condition.

The cold condition would be the situation where the portable container still contained some liquid oxygen or where it had just emptied and was still cold.

The warm condition would be the situation where the portable container was empty and had warmed up to ambient temperature. It will be appreciated that a warm fill will result in more liquid oxygen flashing into gas when the liquid oxygen contacts the warm internals of the container.

In the tests, measurements were recorded for the fill weight in pounds of liquid oxygen, the fill loss in pounds of liquid oxygen, the temperature of quick-closing plug type valve 103 in °F., and the valve 103 delay time in minutes. The quick closing plug type valve delay time is the deliberation time from the initial control action to the termination of the fill.

Table I records the test results for a liquid oxygen fill of a portable liquid oxygen storage-dispensing container as described herein without a splash deflector.

Table II records the test results for a liquid oxygen fill of a portable liquid oxygen storage-dispensing container as described herein with a splash deflector in accordance with the present invention.

TABLE I

| Inverted Fill Without Splash Deflector | | | | | |
|---|---|---|---|---|---|
| Test No. | Fill Type | Fill Weight Lbs | Fill Loss Lbs. | Valve Temp. °F. | Valve Delay Time (Minutes) |
| 1 | Warm | 1.48 | 0.79 | 10 | 0.26 |
| 2 | Cold | 1.58 | 0.52 | 20 | 0.10 |
| 3 | Warm | 1.52 | 0.83 | −25 | 0.37 |
| 4 | Cold | 1.69 | 0.49 | 20 | 0.14 |
| 5 | Warm | 1.73 | 1.13 | −15 | 0.33 |
| 6 | Cold | 1.68 | 0.80 | 14 | 0.09 |

TABLE II

| Inverted Fill with Splash Deflector | | | | | |
|---|---|---|---|---|---|
| Test No. | Fill Type | Fill Weight Lbs | Fill Loss Lbs. | Valve Temp. °F. | Valve Delay Time(Minutes) |
| 7 | Warm | 1.68 | 0.07 | 38 | 0.06 |
| 8 | Cold | 1.60 | 0.50 | 22 | 0.09 |
| 9 | Warm | 1.68 | 0.76 | 30 | 0.07 |
| 10 | Cold | 1.68 | 0.44 | 30 | 0.06 |
| 11 | Warm | 1.74 | 0.70 | 25 | 0.12 |
| 12 | Cold | 1.69 | 0.52 | 15 | 0.10 |

Comparing the data of Table I and Table II, it is seen that the temperature of the quick-closing plug type fill termination valve is colder during both warm and cold fills for a portable container which does not have a splash deflector plate than for a portable container having a splash deflector plate in accordance with the present invention. The valve delay time, that is the deliberation time from the initial control action to the termination of fill, is high especially during warm fill for portable containers without a splash deflector plate. For container having a splash deflector plate in accordance with the present invention, the valve delay time is low for both warm and cold fills and is generally uniform. Thus the use of a splash deflector plate in combination with the desirable structurally simple concentric liquid withdrawal-gas vent tube and the gas vent-liquid fill tube in accordance with the present invention yields the desired safe and reliable precise fill termination control in a structurally simple manner.

Examination of the data also demonstrates that fill loss for a container in accordance with the present invention during warm fill condition is considerably lower.

The splash deflector of the present invention is deflecting the fluid discharged from the gas vent-liquid fill tube toward the enclosed volume top end [which is down in the inverted fill position] and away from the enclosed volume bottom end where the vent gas is entering the liquid withdrawal-gas vent tube and escaping to atmosphere via the fill termination system.

It is believed that the fluid redirection combined with the lowering of the velocity of the redirected fluid by the splash deflector plate is causing a substantial disengagement of liquid and gas and therefore decreasing the amount of entrained liquid which is being carried by the venting gas into the automatic fill termination circuit.

It is to be noted that the angle $\alpha$ at bend 72 of gas vent-liquid fill tube 70 suitably ranges from about 140° to 165°. It will be readily appreciated by one skilled in the art that it is not practical to insert a small tube within a larger tube such as is required for the desirable concentric tube arrangement of the present invention with a decreased angle of bend unless the larger tube becomes very large relative to the smaller tube. Thus it is not practical to use tubing in this system that includes or approximates a U-bend. It may be possible to utilize a two piece construction wherein tube 70 penetrates the wall of tube 30 and then mounting an additional tubing piece on the protruding end of tube 70 to redirect the discharged fluid toward enclosed volume top end 11*a*. However, this would add undesired structural complexity to the system and introduce a joint which could fail, remain undetected and derogate the desired reliable, precise control of the fill termination system.

Furthermore, it is believed that the lowering of deflected fluid velocity by the splash deflector plate geometry enhances the desired liquid-gas separation. Moreover, the splash plate achieves the required results in a reliable, structurally simple manner when combined with the desired structural simplicity of the concentric liquid withdrawal-gas vent and gas vent-liquid fill tube arrangement.

A particular automatic fill termination system and a particular method of portable container liquid oxygen fill have been described herein in order to provide an understanding of the present invention. This description is not intended to limit the present invention as defined in the claims.

Quick-closing plug type valves of the type described in copending U.S. Patent Application Ser. No. 125,889 and variations thereof may be used in the fill termination system described in place of the valve 103 described herein.

The liquid withdrawal-gas vent tube and the gas vent-liquid fill tube arrangement combined with the splash plate of the present invention may be usefully employed with portable liquid oxygen storage-gas supply systems having an automatic fill termination means which includes a cryogenic liquid sensing means for transmitting a signal responsive to the presence of a cryogenic liquid in a gas vent conduit during liquid fill of the portable container which signal causes closure of a valve means or the equivalent in order to terminate the cryogenic liquid fill.

For example, a cryogenic liquid sensing means such as a thermistor could be used. The presence of a cryogenic liquid would cool the thermistor causing a change in the electrical resistance and thus change its electrical output signal. Electrical signal responsive means could be provided to effect closure of, for example, a solenoid valve means to terminate liquid fill upon sensing a selected electrical output signal from the thermistor corresponding to the cooling of the thermistor by the presence of a cryogenic liquid in a gas vent conduit during liquid fill of the portable container.

It is contemplated that the splash deflector in accordance with the present invention for deflecting a fluid discharged from the gas vent—liquid fill tube toward the container top end may be mounted within the container enclosed volume external to the liquid withdrawal—gas vent tube by means other than by being mounted on the liquid withdrawal—gas vent tube.

Preferred embodiments of the present invention have been described in detail. It is contemplated that modifications may be made and that some features may be employed without others, all within the spirit and scope of the invention.

What is claimed is:

1. A cryogenic liquid storage-gas supply system including a double-walled cryogenic liquid storage container having top and bottom ends and being invertible between top-up dispensing and bottom-up filling positions, said container comprising:

(i) an inner wall forming an enclosed volume for receiving a cryogenic liquid;

(ii) an outer wall substantially coextensive with and spaced from said inner wall arranged and constructed with respect to said inner wall so as to form an evacuable space therebetween;

(iii) thermal insulation material disposed within said evacuable space;

(iv) liquid withdrawal-gas vent conduit means including a continuous tube penetrating and gas tightly joined to said inner and outer walls at the container top end said tube having a first end terminating near the enclosed volume bottom end and a second end terminating outside the container top end;

(v) gas vent-liquid fill conduit means including a tube positioned within said liquid withdrawal-gas vent tube and penetrating the wall of said liquid withdrawal-gas vent tube at a position located near the enclosed volume top end and extending through the second end of said liquid withdrawal-gas vent tube, said gas vent-liquid fill tube having a first end terminating near the enclosed volume top end and oriented to discharge a fluid directed away from said container top end and a second end terminating outside the container top end;

(vi) means within said enclosed volume external to said liquid withdrawal-gas vent tube for deflecting the fluid discharged from said first end of said gas vent-liquid fill tube toward the container top end.

2. Apparatus as recited in claim 1 wherein said fluid deflecting means (vi) is mounted on said liquid withdrawal—gas vent tube.

3. Apparatus as recited in claim 1 wherein said fluid deflecting means (vi) comprises a truncated cone mounted on and substantially concentrically surrounding said liquid withdrawal-gas vent tube having an open base oriented to face the container top end and positioned so that the geometric extension of the perimeter of said gas vent-liquid fill tube first end intersects the side of said cone.

* * * * *

UNITED STATES PATENT AND TRADEMARK OFFICE

CERTIFICATE OF CORRECTION

PATENT NO. : 4,299,091

DATED : November 10, 1981

INVENTOR(S) : William J. Carter, Lester K. Eigenbrod

It is certified that error appears in the above—identified patent and that said Letters Patent is hereby corrected as shown below:

Column 4, Line 65 - "bse" should read"base"

Column 12, Line 43 - "0.07" should read "0.70"

Signed and Sealed this

*Second* Day of *March 1982*

[SEAL]

*Attest:*

GERALD J. MOSSINGHOFF

*Attesting Officer*

*Commissioner of Patents and Trademarks*